US008005379B2

(12) United States Patent
Harashima et al.

(10) Patent No.: US 8,005,379 B2
(45) Date of Patent: Aug. 23, 2011

(54) IMAGE FORMING APPARATUS AND IMAGE FORMING METHOD

(75) Inventors: Takashi Harashima, Sagamihara (JP); Osamu Yamada, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 337 days.

(21) Appl. No.: 12/404,363

(22) Filed: Mar. 16, 2009

(65) Prior Publication Data

US 2009/0310994 A1 Dec. 17, 2009

(30) Foreign Application Priority Data

Jun. 16, 2008 (JP) ..... 2008-156314

(51) Int. Cl.
*G03G 15/00* (2006.01)

(52) U.S. Cl. ..... 399/49; 399/51; 399/53

(58) Field of Classification Search ..... 399/38, 399/49, 51, 53–56, 302, 308
See application file for complete search history.

(56) References Cited

U.S. PATENT DOCUMENTS

| | | | | |
|---|---|---|---|---|
| 6,889,015 | B2 | 5/2005 | Shimura | |
| 7,471,908 | B2 * | 12/2008 | Soya et al. | 399/49 |
| 7,664,413 | B2 * | 2/2010 | Kobayashi et al. | 399/49 |
| 7,684,718 | B2 * | 3/2010 | Kunimori | 399/49 |
| 7,720,400 | B2 * | 5/2010 | Taguchi et al. | 399/49 |
| 2005/0030562 | A1 | 2/2005 | Hama et al. | |
| 2005/0185203 | A1 | 8/2005 | Oki | |
| 2007/0134013 | A1 | 6/2007 | Soya et al. | |

FOREIGN PATENT DOCUMENTS

| | | |
|---|---|---|
| JP | 2001-337495 | 12/2001 |
| JP | 2002-258546 A | 9/2002 |
| JP | 2002-061837 A | 2/2004 |
| JP | 2004-61809 A | 2/2004 |
| JP | 2005-062357 | 3/2005 |
| JP | 2005-275378 | 10/2005 |
| JP | 2006-003679 | 1/2006 |
| JP | 2006-047855 | 2/2006 |
| JP | 2006-065184 | 3/2006 |
| JP | 2007-156356 | 6/2007 |
| JP | 2007-218998 | 8/2007 |

OTHER PUBLICATIONS

Preliminary Notice of Rejection issued in the corresponding Japanese Patent Application No. 2008-156314 dated Apr. 20, 2010, and an English Translation thereof.

Office Action (Preliminary Notice of Rejection) dated Jul. 13, 2010, issued in the corresponding Japanese Patent Application No. 2008-156314, and an English Translation thereof.

* cited by examiner

*Primary Examiner* — Hoan Tran
(74) *Attorney, Agent, or Firm* — Buchanan Ingersoll & Rooney PC

(57) ABSTRACT

An image forming apparatus is provided with a control section which stores detection results of a toner sensor regarding detection patterns. When forming a plurality of detection patterns on an intermediate transfer belt, the control section determines circumference-directional lengths of the detection patterns formed this time, based on the detection results of the toner sensor regarding the detection patterns formed immediately before. Thereby, the waste toner amount and toner consumption are not only decreased but also the time taken to detect the density of a detection pattern is reduced, while maintaining the detecting accuracy thereof.

15 Claims, 10 Drawing Sheets

IMAGE FORMING APPARATUS AND IMAGE FORMING METHOD

CROSS-REFERENCE TO RELATED APPLICATION

This application is based on application No. 2008-156314 filed in Japan, the entire content of which is hereby incorporated by reference.

BACKGROUND OF THE INVENTION

The present invention relates to an image forming apparatus such as a copying machines, a laser printer and a facsimile, and relates to a image forming method.

Generally, image density of toner images in an image forming apparatus may be changed due to disturbances such as an environmental change in temperature or humidity around the apparatus or a change in durability of the apparatus.

In order to stabilize the image density, one of conventional image forming apparatuses forms test toner images (hereinafter referred to as "detection patterns") on a photoconductor, so that a developing bias, which affects the image density, is optimized on the basis of densities of the detection patterns (see JP 2004-61809 A).

Specifically, the developing bias is variously changed and set while the detection patterns are formed on the photoconductor and transferred onto an intermediate transfer body. Then, a density sensor detects the densities of the detection patterns on the intermediate transfer body. A desired image density is obtained by adjusting the developing biases so that one of the detected densities reaches a preset target density.

When densities of detection patterns are low, irregularity in densities becomes pronounced. Under harmful influence of the density irregularity, outputs from the density sensor may be greatly varied, so that it becomes impossible to accurately detect the densities of the detection patterns. To enhance the detection accuracy, densities of plural detection patterns are detected to obtain an average of the densities, while lengths of the detection patterns are set to be longer than a peripheral length of the photoconductor.

In the conventional image forming apparatus, however, there have been a problem that the amounts of waste toner and toner consumption are increased, and a problem that time taken to detect the densities of detection patterns becomes long because each length of the detection patterns is longer than the peripheral length of the photoconductor.

SUMMARY OF THE INVENTION

An object of the invention is to provide an image forming apparatus which decreases the waste toner amount and toner consumption and reduces the time taken to detect densities of detection patterns while maintaining the detecting accuracy thereof.

In order to achieve the above-mentioned object, a first aspect of the present invention provides an image forming apparatus, comprising: a conveying rotation unit for conveying a toner image formed on an outer surface of the conveying rotation unit by rotating movement of the conveying rotation unit; a toner amount changing section for changing a toner adhering amount of the toner image formed on the conveying rotation unit; a toner length changing section for changing a length of the toner image formed on the conveying rotation unit in a circumferential direction of the conveying rotation unit; a toner amount detecting section for detecting the toner adhering amount of the toner image formed on the conveying rotation unit; and a control section for controlling the toner amount changing section and the toner length changing section and for storing a detection result of the toner amount detecting section, wherein the toner amount detecting section detects a toner adhering amount of a detection pattern of a toner image formed on the conveying rotation unit, based on a detection result of the toner amount detecting section regarding the toner adhering amount, the control section controls the toner amount changing section to form a toner image having a given toner adhering amount on the conveying rotation unit, when a detection pattern is formed on the conveying rotation unit, the control section determines a circumference-directional length of the detection pattern formed this time, based on the detection result of the toner amount detecting section regarding the detection pattern formed immediately before.

According to the first aspect of the present invention, the control section stores the detection result of the toner amount detecting section regarding the detection pattern. When a detection pattern is formed on the conveying rotation unit, the control section determines a circumference-directional length of the detection pattern formed this time, based on the detection result of the toner amount detecting section regarding a detection pattern formed immediately before. Therefore, when the detection pattern formed immediately before has a large amount of adhering toner, the detection pattern this time is formed to have a pattern length shortened. This makes it possible to decrease the waste toner amount and toner consumption without deteriorating the detecting accuracy of the detection pattern. It also becomes possible to reduce the time taken to detect the toner adhering amount of the detection pattern. Herein, it should be noted that "a circumference-directional length of the detection pattern" is defined as a length of the detection pattern in the circumferential direction of the intermediate transfer belt, that is, in the rotational transfer direction of the intermediate transfer belt.

A second aspect of the present invention provides an image forming method, comprising the steps for: forming a detection pattern of a toner image on a conveying rotation unit; detecting a toner adhering amount of the detection pattern by using a toner amount detecting section; and forming a toner image of a given toner adhering amount on the conveying rotation unit, based on a detection result of the toner amount detecting section, wherein when a detection pattern is formed on the conveying rotation unit, a circumference-directional length of a detection pattern formed this time is determined, based on the detection result of the toner amount detecting section regarding the detection pattern formed immediately before.

According to the second aspect of the present invention, when a detection pattern is formed on the conveying rotation unit, the control section determines a circumference-directional length of the detection pattern formed this time, based on the detection result of the toner amount detecting section regarding a detection pattern formed immediately before. Therefore, as in the case of the first aspect of the invention, when the detection pattern immediately before has a large amount of adhering toner, the detection pattern this time is formed to have a pattern length shortened. This makes it possible to decrease the waste toner amount and toner consumption without deteriorating the detecting accuracy of the detection pattern. It also becomes possible to reduce the time taken to detect the toner adhering amount of the detection pattern.

A third aspect of the present invention provides an image forming method for forming a detection pattern of a toner image on a conveying rotation unit by using a developing device set to a predetermined developing bias, detecting a toner adhering amount of the formed detection pattern, and setting imaging conditions for actual image formation, based on the detected toner adhering amount, comprising the steps for: storing the toner adhering amount of the detected detection pattern; and setting a circumference-directional length of a detection pattern formed this time on a peripheral surface of a conveying rotation unit, based on the toner adhering amount formed and stored immediately before.

According to the third aspect of the present invention, a circumference-directional length of the detection pattern formed this time on the outer surface of the conveying rotation unit is set based on the toner adhering amount formed and stored immediately before. Therefore, as in the case of the first and second aspects of the invention, when the detection pattern formed immediately before has a large amount of adhering toner, the detection pattern this time is formed to have a pattern length shortened. This makes it possible to decrease the waste toner amount and toner consumption without deteriorating the detecting accuracy of the detection pattern. It also becomes possible to reduce the time taken to detect the toner adhering amount of the detection pattern.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Hereinbelow, embodiments of the present invention will be described in details with reference to the drawings by way of illustration.

Figure 1:
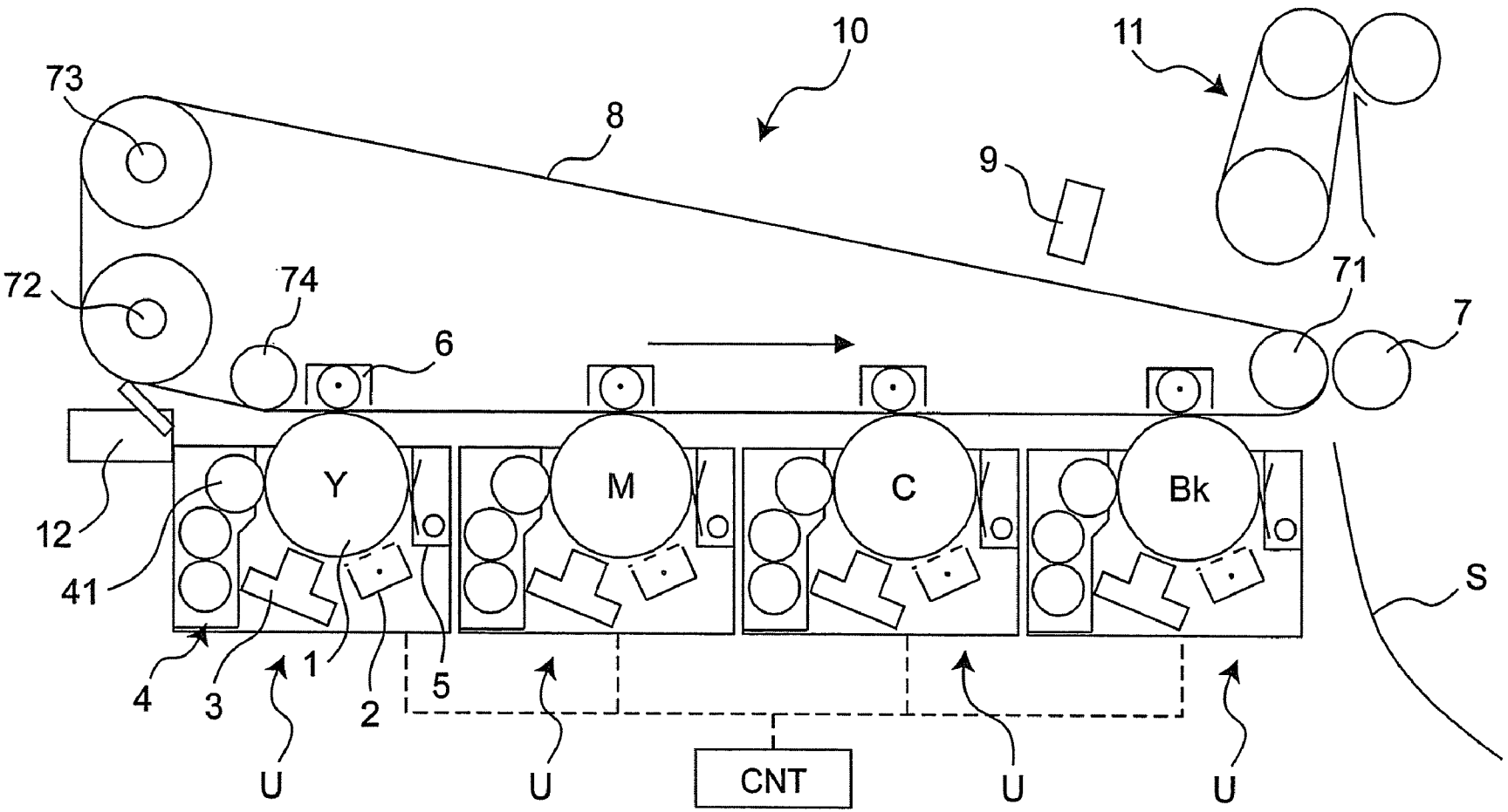
FIG. 1 shows a simplified structure view of an image forming apparatus in one embodiment of the present invention.

An image forming apparatus in one embodiment of the present invention is shown in FIG. 1. The imaging device 10 is composed of an imaging device 10 and a fixing device 11. The imaging device 10 is for attaching unfixed toner to recording paper sheets S so as to form images. The fixing device 11 is for melting the toner and fixing it to the recording paper sheets. The image forming apparatus is an electrophotographic four-color color printer.

The imaging device 10 has an intermediate transfer belt 8, four image forming units U, a primarily transfer roller 6, and a secondary transfer roller 7. The four image forming units U are placed along the intermediate transfer belt 8 for forming toner images. The primarily transfer roller 6 transfers the toner images formed by each of the image forming units U onto the intermediate transfer belt 8. The secondary transfer roller 7 transfers the images transferred onto the intermediate transfer belt 8 onto recording paper sheets S.

The intermediate transfer belt 8 is stretched over rollers 71, 72, 73, and 74. On the intermediate transfer belt 8, a cleaning device 12 is placed to collect the toner remaining on the intermediate transfer belt 8. Above the intermediate transfer belt 8, a toner sensor 9 is placed to detect the toner adhering amounts of toner images formed on the intermediate transfer belt 8.

An image forming units U to form yellow (Y), magenta (M), cyan (C) and black (BK) toner images are placed in this order along from upstream to downstream of the intermediate transfer belt 8.

Each of the image forming units U has a photoconductor 1, a charging device 2 for uniformly charging the photoconductor 1, an exposure device 3 for performing image exposure of the charged photoconductor 1, and a developing device 4 for developing an electrostatic latent image formed by the exposure with the toner of each color.

The developing device 4 has a developing roller 41 so that the toner is attached from the developing roller 41 to the photoconductor 1. A cleaner 5 is placed on the photoconductor 1 to collect the toner remaining on the photoconductor 1. All the image forming units U are controlled by a control section CNT.

Description is now given on operations of the image forming apparatus.

The toner image developed on the photoconductor 1 in the image forming unit U is primarily transferred onto the intermediate transfer belt 8 by the primary transfer roller 6 at a contact position with the intermediate transfer belt 8.

Whenever a toner image transferred from the photoconductor 1 onto the intermediate transfer belt 8 passes the other image forming units U, respective colors are placed on top of the toner image, so that the toner image in full color is finally formed on the intermediate transfer belt 8.

Then, the full color toner image on the intermediate transfer belt 8 is secondarily transferred onto a recording paper sheet S in the downstream of the intermediate transfer belt 8 by using the secondary transfer roller 7.

The recording paper sheet S then passes the fixing device 11 positioned at the downstream of a conveying path of the recording paper sheet S. Thereby, the toner image of the recording paper sheet S is fixed. Thereafter, the recording paper sheet S is discharged onto a paper output tray (not shown).

The recording paper sheets S, which are stored in a lowermost cassette (not shown), are conveyed one by one from the cassette to the secondary transfer roller 7.

The toner remaining on the photoconductor 1 after primary transfer is removed by the cleaner 5 placed downstream and is collected in an unshown waste toner box.

The toner remaining on the intermediate transfer belt 8 after secondary transfer is collected by the cleaning device 12.

The image densities of toner images may be different due to disturbances such as an environmental change in temperature or humidity around the apparatus or a change in durability of the apparatus. To stabilize the image densities, the image forming apparatus forms test toner images (hereinafter referred to as "detection patterns") on the photoconductor 1. Based on the toner adhering amounts (densities) of the detection patterns, the developing bias which affects the image density is optimized. This is hereinafter referred to as "adhering amount control".

In short, the toner images from the photoconductor 1 are formed on the intermediate transfer belt 8 (as a conveying rotation unit), and conveyed by rotation of the intermediate transfer belt 8. The developing device 4 (as a toner amount changing section) changes the toner adhering amounts of the toner images formed on the intermediate transfer belt 8.

The developing device 4 and the exposure device 3 (as a toner length changing section) change lengths of the toner images, which are formed on the intermediate transfer belt 8, along the circumferential direction of the intermediate transfer belt 8. The toner sensor 9 (as a toner amount detecting section) detects the toner adhering amounts of the toner images formed on the intermediate transfer belt 8.

The control section CNT controls both the developing device 4 and the exposure device 3 to form the toner images, as detection patterns, on the intermediate transfer belt 8. The toner sensor 9 detects the toner adhering amounts of the detection patterns. Based on the detection results of the toner sensor 9, the control section CNT controls the developing device 4 to form the toner images of given toner adhering amounts on the intermediate transfer belt 8.

Description is now given on mechanism of the adhering amount control.

Figure 2:
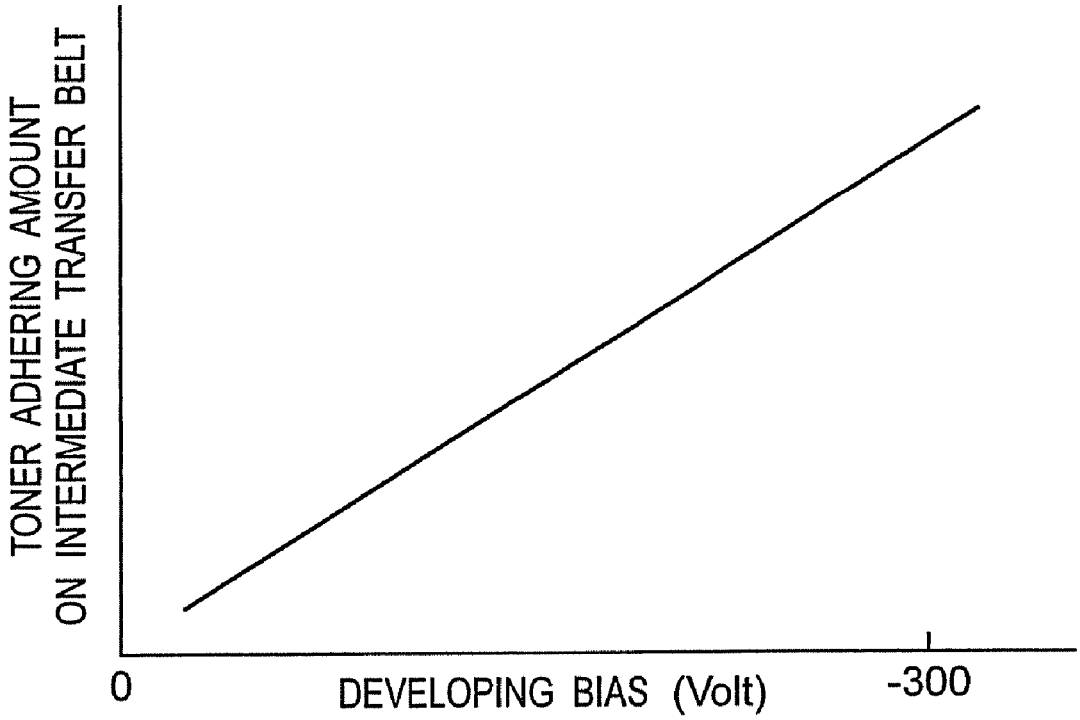
FIG. 2 shows a graph view of relation between a developing bias and a toner adhering amount on an intermediate transfer belt.

FIG. 2 shows relation between developing biases of the developing device 4 and toner adhering amounts on the intermediate transfer belt 8, wherein the developing biases and the toner adhering amounts are in direct proportion to each other.

Figure 3A:
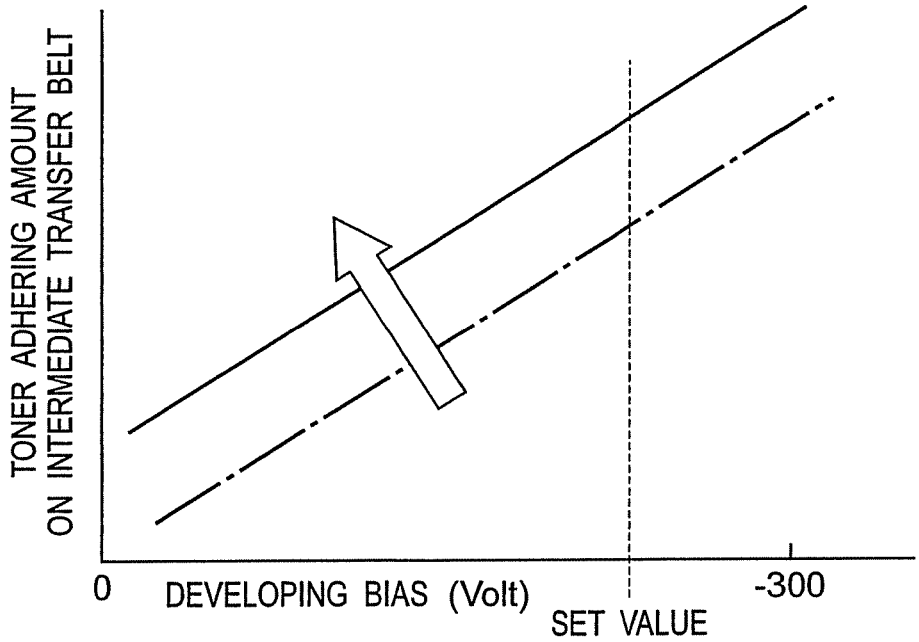
FIG. 3A shows a graph view of relation between the developing bias and the toner adhering amount on the intermediate transfer belt in a high-humidity state.
Figure 3B:
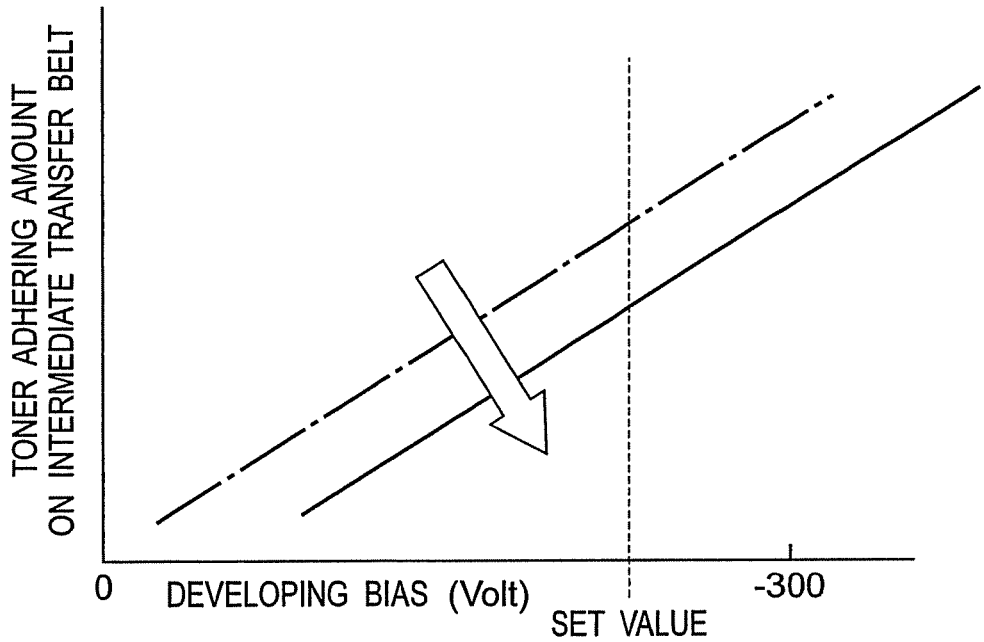
FIG. 3B shows a graph view of relation between the developing bias and the toner adhering amount on the intermediate transfer belt in a low-humidity state.

Even when the same developing bias is applied, disturbance from environment or durability may change the toner adhering amount of detection patterns formed on the intermediate transfer belt 8. The toner adhering amount increases when the relation is changed as seen in FIG. 3A, for example, under the state of high humidity. As the result, the image density outputted becomes high. The toner adhering amount decreases when the relation is changed as seen in FIG. 3B, for example, under the low-humidity state. As the result, the image density outputted becomes low.

To stabilize the outputted image densities, the toner adhering amounts needs to be controlled by the adhering amount control. The developing bias needs to be controlled so that proper toner adhering amounts are constantly put on the intermediate transfer belt 8.

At the time of the adhering amount control, the detection patterns are formed on the intermediate transfer belt 8 and detected by the toner sensor 9. Then the detection results thereof are converted into the toner adhering amounts. Based on the detection results of the toner adhering amounts, the developing bias is set in such a way that an image having a proper density may be outputted after execution of the adhering amount control.

Description is now given on five detection patterns.

Figure 4:
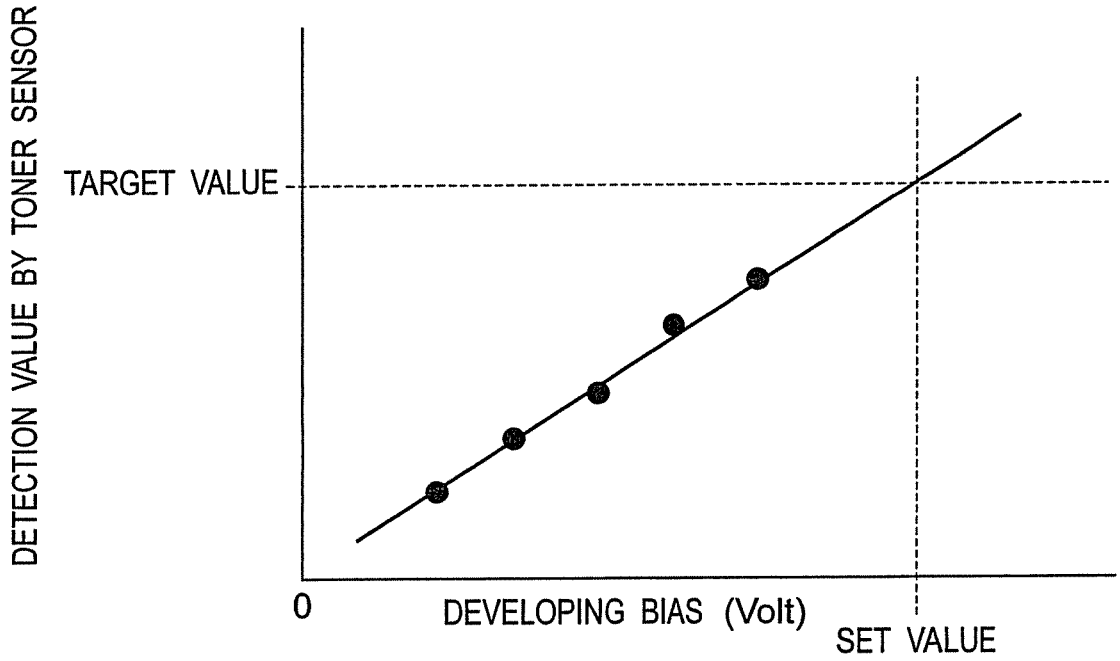
FIG. 4 shows a graph view of relation between the developing bias and detection values by using a toner sensor.

In FIG. 4, the horizontal axis represents a developing bias, and the vertical axis represents a detection value by the toner sensor. Black dots denote values that the toner sensor 9 has detected on detection patterns. The values in FIG. 4 detected by the toner sensor 9 are values obtained by converting actual outputs of the sensor 9 into toner adhering amounts, based on the toner adhering amount detection characteristics of the toner sensor 9.

A target value for the toner sensor detection values is predetermined, where the target value leads to a proper adhering amount of toner. The five black dots, which are derived from detection results of the five detection patterns, can be connected to draw a straight line. A set value of the developing bias is obtained from a point on the straight line based on the target value.

Figure 5A:
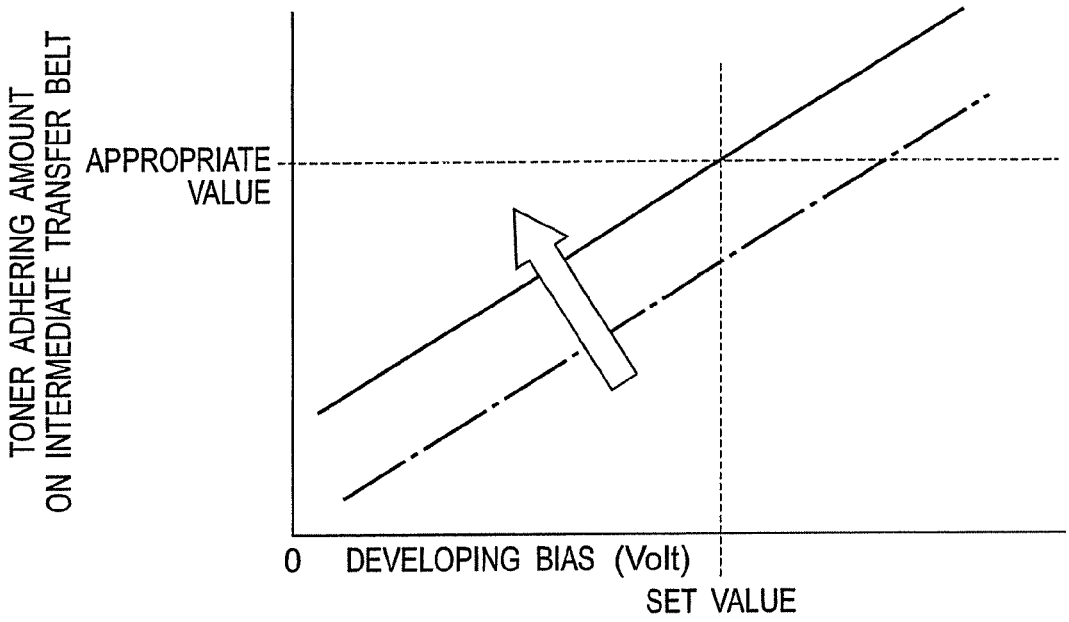
FIG. 5A shows a graph view explaining a developing bias set value in the state of FIG. 3A.

When the relation between the developing bias and the toner adhering amount on the intermediate transfer belt 8 is changed as shown in FIG. 3A, a lower set value of the developing bias is obtained by calculation with the adhering amount control, as shown in FIG. 5A.

Figure 5B:
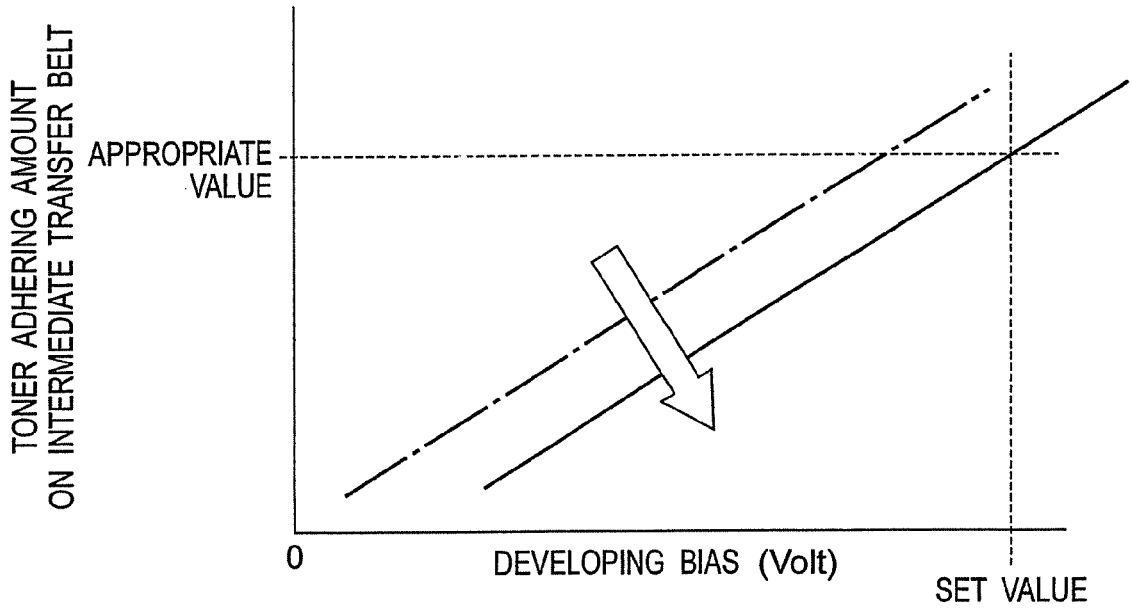
FIG. 5B shows a graph view explaining a developing bias set value in the state of FIG. 3B.

When the relation between the developing bias and the toner adhering amount on the intermediate transfer belt 8 is changed as seen in FIG. 3B, a higher set value of the developing bias is obtained by calculation with the adhering amount control, as shown in FIG. 5B.

Thus, in order to stabilize the image densities of outputted images, the developing bias is controlled by the toner adhering amount control in such a way that the proper adhering amount of toner is constantly put on the intermediate transfer belt 8.

The toner adhering amount control is performed, for example, when power supply is turned on, when the apparatus is returned from a sleep mode, when a predetermined time is passed, and when a predetermined number of pages are printed.

The control section CNT in the image forming apparatus stores the detection results of the toner sensor 9 regarding the detection patterns. When the detection patterns are formed on the intermediate transfer belt 8, the control section CNT determines circumference-directional lengths of the detection patterns formed this time, based on the detection results of the toner sensor 9 regarding the detection patterns formed immediately before.

The control section CNT sets shorter the circumference-directional lengths of the detection patterns formed this time, as the toner adhering amount is larger, based on the detection results of the toner sensor 9 regarding detection patterns formed immediately before.

The toner adhering amount of the detection pattern corresponds to the contrasting density of toner. Alternatively, the toner adhering amount of the detection pattern corresponds to an area rate of toner. The area rate of toner is defined as a percentage of toner in an area of the pattern.

Specifically, the lengths of the detection patterns are determined by using the detection results of the sensor in the previous adhering amount control. The following data of Table 1 are preinstalled, where the lengths of detection patterns are prescribed on the basis of detection values by the toner sensor in the previous adhering amount control.

The greater the value of the sensor detection result is, the smaller the toner adhering amount becomes. In other words, the toner sensor 9 detects a light beam reflected from a part of the intermediate transfer belt 8, where toner fails to dominate in the detection patterns.

TABLE 1

| Sensor detection result in previous control | Length of detection pattern | Number of sampling points |
|---|---|---|
| 80- | L | N |
| 60-80 | (4/5) × L | (4/5) × N |
| 40-60 | (3/5) × L | (3/5) × N |
| 20-40 | (2/5) × L | (2/5) × N |
| 0-20 | (1/5) × L | (1/5) × N |

Figure 6:
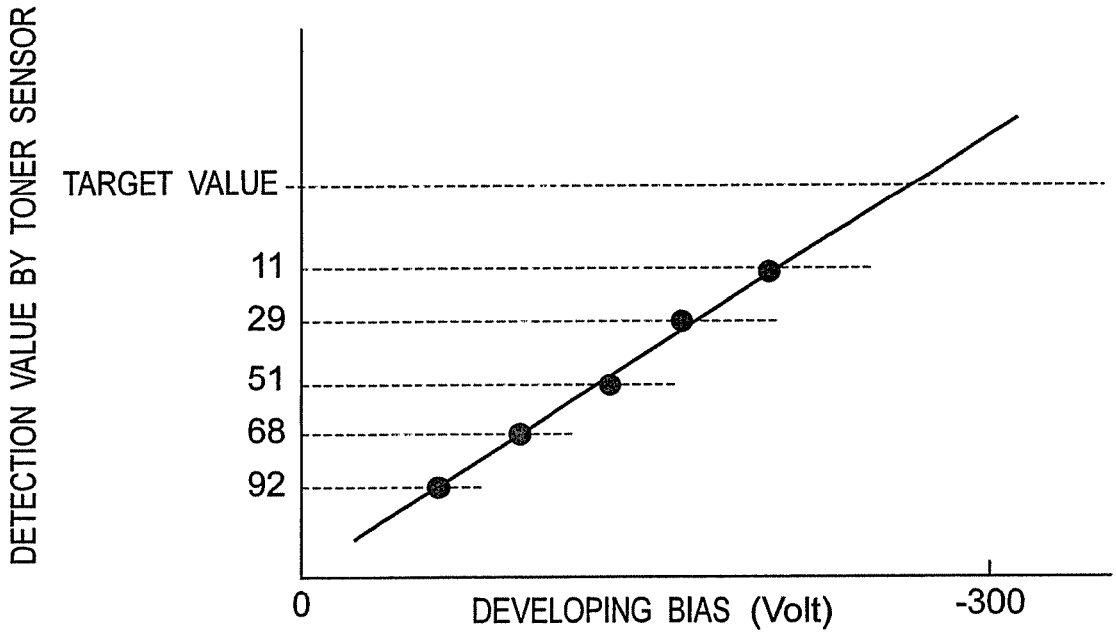
FIG. 6 shows a graph view of an exemplified detection result of detection patterns.

FIG. 6 shows detection values detected by the toner sensor at the time of the adhering amount control. In FIG. 6, the detection values are 92 for the first pattern, 68 for the second pattern, 51 for the third pattern, 29 for the fourth pattern, and 11 for the fifth pattern. For next time, the lengths of the detection patterns at the time of the adhering amount control are determined on the basis of Table 1: L for the first pattern, (4/5)×L for the second pattern, (3/5)×L for the third pattern, (2/5)×L for the fourth pattern, and (1/5)×L for the fifth pattern.

The developing biases used for the first to fifth patterns are respectively kept constant every time by the adhering amount control. For example, the developing bias of the first pattern is −100V, the developing bias of the second pattern is −120V, the developing bias of the third pattern is −140V, the developing bias of the fourth pattern is −160V, and the developing bias of the fifth pattern is −180V.

Figure 7:
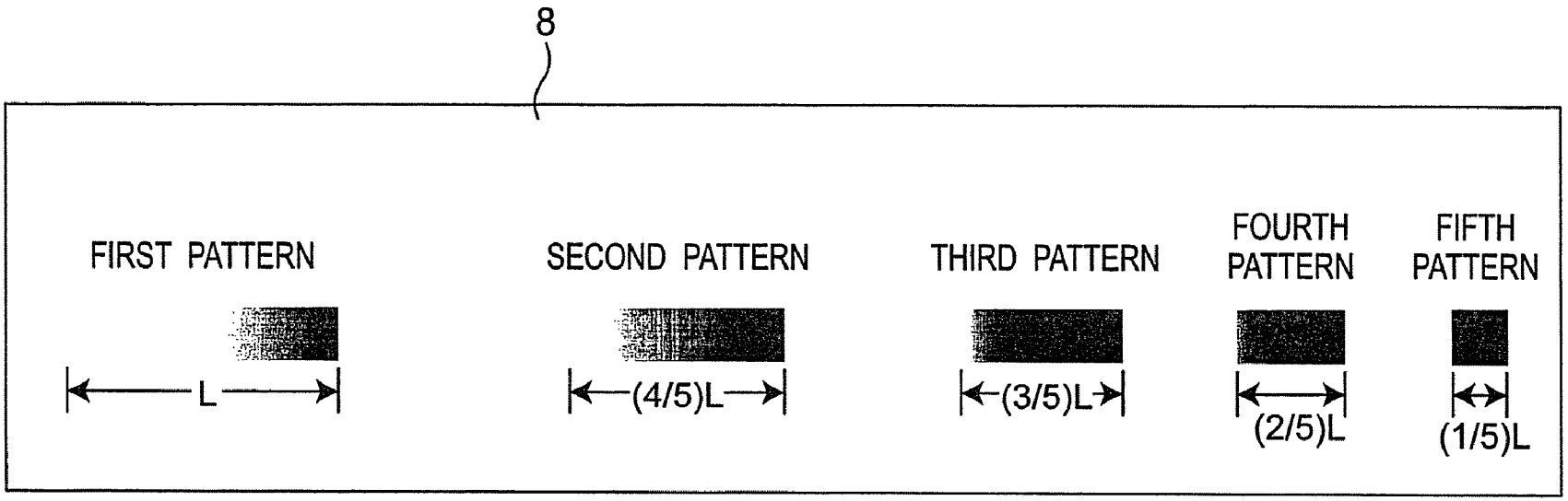
FIG. 7 shows a plan view of detection patterns formed on the basis of FIG. 6.

As shown in FIG. 7, five patterns with the determined lengths are formed on the intermediate transfer belt 8. Specifically, as the toner adhering amount increases, the length of the pattern is made shorter, and the number of sampling points by the toner sensor 9 is set smaller. The toner adhering amount for each pattern is obtained by taking an average of the sampled values for every pattern.

Figure 10:
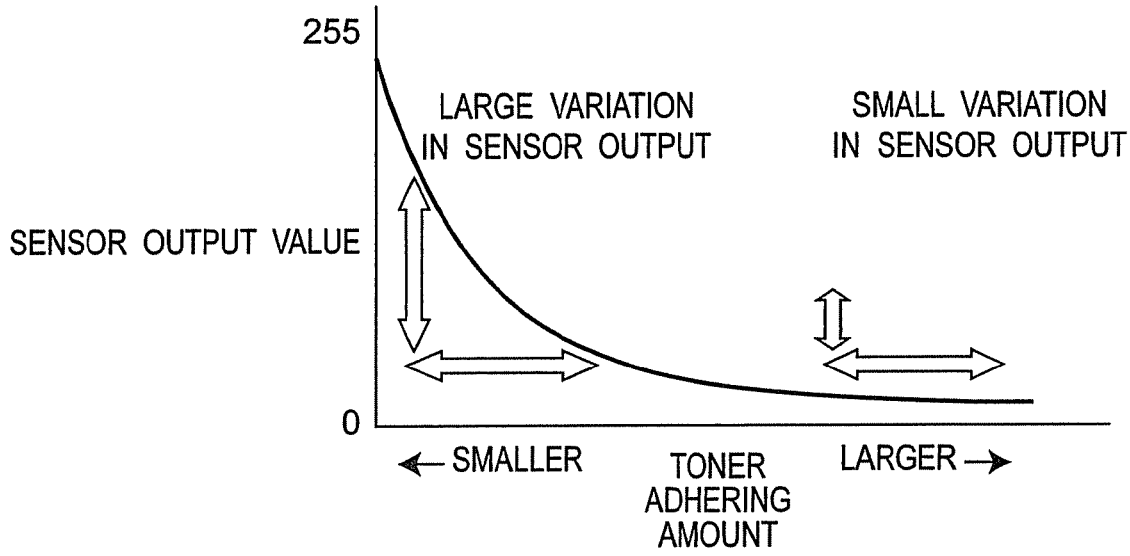
FIG. 10 shows a graph view of relation between a toner adhering amount and a toner sensor output value.

As shown in FIG. 10, according to detecting characteristics of the toner adhering amounts, when the toner adhering amount is smaller, variation in the sensor outputs increases under influence of irregularity in adhering amounts in the detection patterns. On the other hand, when the toner adhering amount is larger, variation in the sensor outputs decreases due to less influence of irregularity in the adhering amounts in the detection patterns. In the case where the toner adhering amount is large, because of these characteristics, the accuracy of sensor outputs can be maintained even when the pattern length is made shorter.

Figure 8:
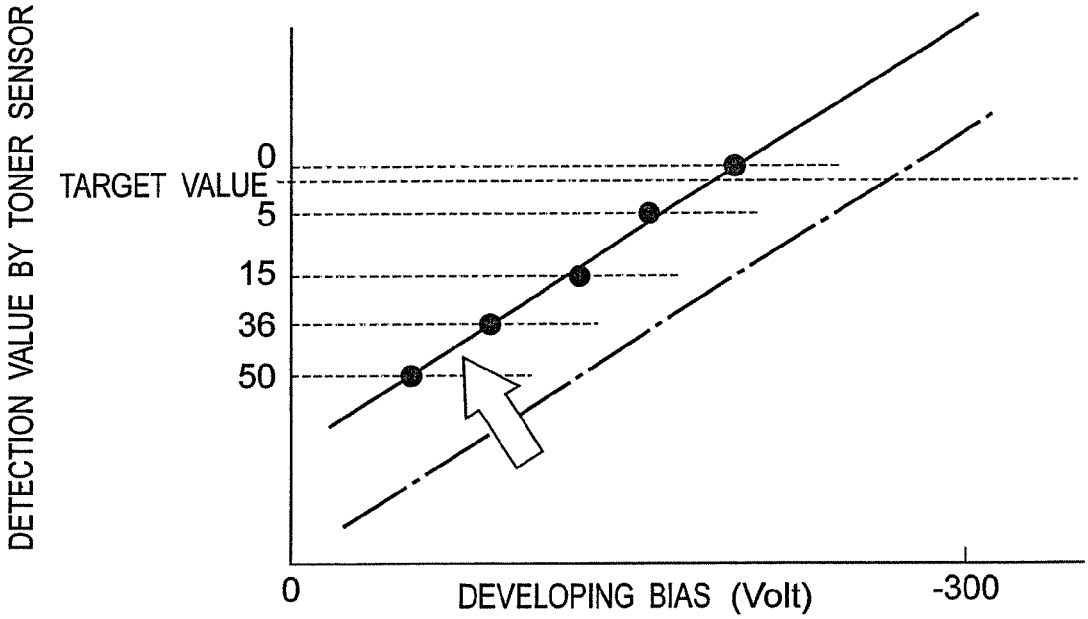
FIG. 8 shows a graph view of another exemplified detection result of the detection patterns.

FIG. 8 shows detection values by the toner sensor at the time of the adhering amount control for the next time, where the detection values are 50 for the first pattern, 36 for the second pattern, 15 for the third pattern, 5 for the fourth pattern, and 0 for the fifth pattern. The lengths of the detection patterns at the time of the adhering amount control for subsequent time are determined to be (3/5)L for the first pattern, (2/5)L for the second pattern, (1/5)L for the third pattern, (1/5)L for the fourth pattern, and (1/5)L for the fifth pattern, based on Table 1.

Figure 9:
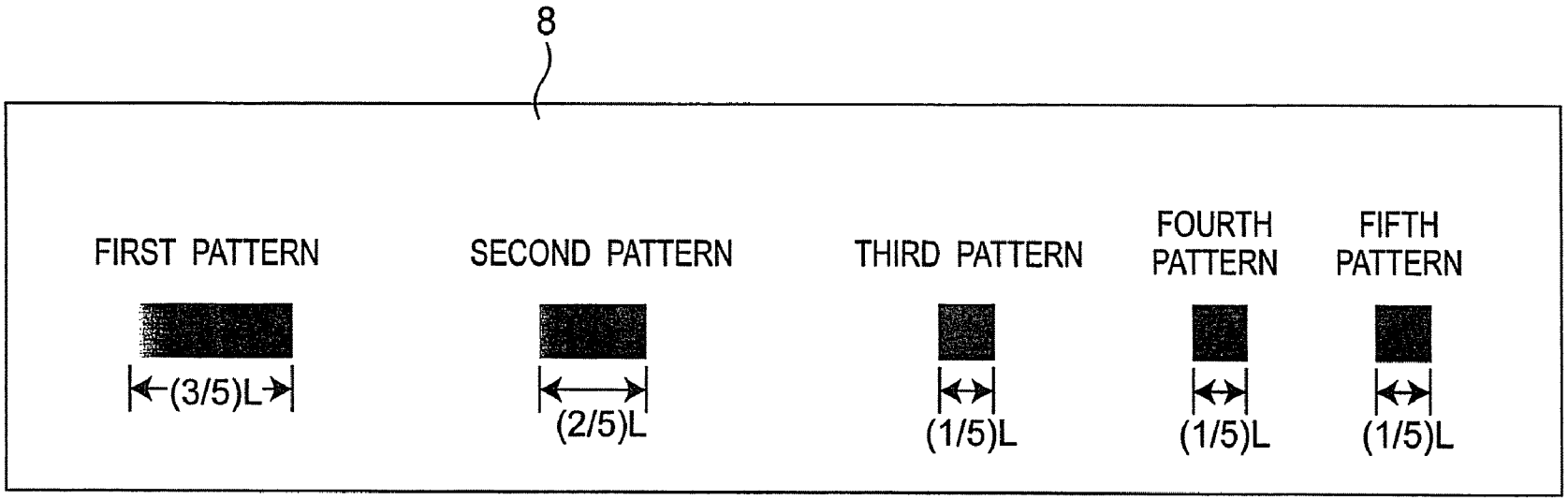
FIG. 9 shows a plan view of the detection patterns formed on the basis of FIG. 8.

As shown in FIG. 9, five patterns having determined lengths are then formed on the intermediate transfer belt 8. As the toner adhering amount increases, the length of the pattern is made shorter and the number of sampling points by the toner sensor 9 may be made smaller.

In Table 1, which prescribes the lengths of detection patterns, the lengths of the detection patterns are gradually shortened at regular intervals in response to the sensor detection results. As shown in Table 2 below, however, the lengths of the patterns may not be shortened at regular intervals.

TABLE 2

| Sensor detection result in previous control | Length of detection pattern | Number of sampling points |
|---|---|---|
| 80- | L | N |
| 60-80 | L | N |
| 40-60 | (½) × L | (½) × N |
| 20-40 | (½) × L | (½) × N |
| 0-20 | (½) × L | (½) × N |

Next, description is given on an image forming method of the invention. Toner images, as detection patterns, are formed on the intermediate transfer belt 8 (as a conveying rotation unit). Toner adhering amounts of the detection patterns are detected by the toner sensor 9 (as a toner amount detecting section). Based on the detection results of this toner sensor 9, each of toner images having given toner adhering amounts is then formed on the intermediate transfer belt 8 as an image.

When detection patterns are formed on the intermediate transfer belt 8, circumference-directional lengths of the detection patterns formed this time are determined, based on the detection results of the toner sensor 9 regarding detection patterns formed immediately before.

The circumference-directional lengths of the detection patterns formed this time are set to be longer as the toner adhering amounts of detection patterns formed immediately before are smaller. This makes it possible to enhance the accuracy in detecting the detection patterns.

The number of sampling points is set, based on the toner adhering amounts of the detection patterns formed immediately before. Thus, it becomes possible to enhance the detecting accuracy of the detection patterns, while reducing the time taken to detect the toner adhering amounts of the detection patterns.

The number of sampling points is set to be larger as the toner adhering amounts of the detection patterns formed immediately before are smaller. Thus, the large number of sampling points makes it possible to enhance the detecting accuracy of the detection patterns.

According to the above-structured image forming apparatus, the control section CNT stores the detection results by the toner sensor 9 regarding the detection patterns. When a plurality of detection patterns are formed on the intermediate transfer belt 8, the control section CNT determines circumference-directional lengths of the detection patterns formed this time, based on the detection results of the toner sensor 9 regarding the detection patterns formed immediately before. Thus, without deteriorating the detecting accuracy of the detection patterns, the amount of waste toner and the consumption of toner can be decreased by shortening the pattern lengths this time, in the case where the detection patterns immediately before have a large amount of adhering toner. It also becomes possible to reduce the time taken to detect the toner adhering amounts of the detection patterns.

The adhering amount control can be achieved so accurately that the toner adhering amounts of the detection patterns formed on the intermediate transfer belt 8 may be different from each other.

According to the image forming method of the above structure, when a plurality of detection patterns are formed on the intermediate transfer belt 8, circumference-directional lengths of the detection patterns formed this time are determined, based on the detection result of the toner sensor 9 regarding the detection patterns formed immediately before. Therefore, without deteriorating the detecting accuracy of the detection pattern, the amount of waste toner and the consumption of toner can be decreased by shortening the pattern lengths this time, in the case where the detection patterns immediately before have a large amount of adhering toner. It also becomes possible to reduce the time taken to detect the toner adhering amount of the detection pattern.

As stated in the foregoing embodiment, the developing biases are changed in the case of forming actual images. However, without being limited to this, it is also acceptable to change an amount of laser light, a dot diameter of laser light or the like. More specifically, as stated above, each of the toner images is formed as a detection pattern on the intermediate transfer belt 8 by using the developing device 4 which is set to a given developing bias. The toner adhering amounts of the formed detection patterns are detected, so that the imaging conditions for actual image formation are set, based on this detected toner adhering amounts. At that time, the detected toner adhering amounts of the detection patterns are stored. Then, circumference-directional lengths of the detection patterns formed this time on an outer surface of the intermediate transfer belt 8 is set, based on the toner adhering amounts which is formed and stored immediately before. In such a case, images may be formed by adjusting the exposure amounts or the exposure patterns instead of adjusting the developing biases, that is to say, while the values of developing biases are kept constant whenever a detection pattern is formed.

The present invention shall not be limited to the above-disclosed embodiments. For example, it is not necessarily required to create a plurality of detection patterns. One pattern may be created and the toner adhering amount thereof may be stored, and when the next detection pattern is to be created, the length of the detection pattern may be determined based on the stored value.

Although the detection patterns formed on the intermediate transfer belt 8 have been detected by the toner sensor 9, instead, detection patterns formed on the photoconductor 1 may be detected by a toner sensor. The image forming apparatus may be any apparatus including monochrome/color copying machines, printers, facsimiles, and multi-functional machines.

The invention has been described above, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. An image forming apparatus, comprising:

a conveying rotation unit for conveying a toner image formed on an outer surface of the conveying rotation unit by rotating movement of the conveying rotation unit;

a toner amount changing section for changing a toner adhering amount of the toner image formed on the conveying rotation unit;

a toner length changing section for changing a length of the toner image formed on the conveying rotation unit in a circumferential direction of the conveying rotation unit;

a toner amount detecting section for detecting the toner adhering amount of the toner image formed on the conveying rotation unit; and a control section for controlling the toner amount changing section and the toner length changing section and for storing a detection result of the toner amount detecting section, wherein the toner amount detecting section detects a toner adhering amount of a detection pattern of a toner image formed on the conveying rotation unit, based on a detection result of the toner amount detecting section regarding the toner adhering amount, the control section controls the toner amount changing section to form a toner image having a given toner adhering amount on the conveying rotation unit, when a detection pattern is formed on the conveying rotation unit, the control section determines a circumference-directional length of the detection pattern formed this time, based on the detection result of the toner amount detecting section regarding the detection pattern formed immediately before.

2. The image forming apparatus set forth in claim 1, wherein when a detection pattern is formed on the conveying rotation unit, as the toner adhering amount is larger as an amount based on the detection result of the toner amount detecting section regarding the detection pattern formed immediately before, the control section makes a shorter circumference-directional length of the detection pattern formed this time.

3. The image forming apparatus set forth in claim 1, wherein the toner adhering amount of the detection pattern corresponds to contrasting density of toner.

4. The image forming apparatus set forth in claim 1, wherein the toner adhering amount of the detection pattern corresponds to an area rate of toner which is a proportion of toner within an area of the pattern.

5. The image forming apparatus set forth in claim 1, wherein a plurality of the detection patterns are formed on the conveying rotation unit, and toner adhering amounts of the detection patterns are different from each other.

6. An image forming method, comprising the steps for:

forming a detection pattern of a toner image on a conveying rotation unit;

detecting a toner adhering amount of the detection pattern by using a toner amount detecting section; and forming a toner image of a given toner adhering amount on the conveying rotation unit, based on a detection result of the toner amount detecting section, wherein when a detection pattern is formed on the conveying rotation unit, a circumference-directional length of a detection pattern formed this time is determined, based on the detection result of the toner amount detecting section regarding the detection pattern formed immediately before.

7. The image forming method set forth in claim 6, wherein the circumference-directional length of the detection pattern formed this time is set to be longer as the toner adhering amount of the detection pattern formed immediately before is smaller.

8. The image forming method set forth in claim 6, wherein detection of the toner adhering amount of the detection pattern is performed by obtaining an average value of a plurality of sampling points of the detection pattern, and a number of sampling points is set, based on the toner adhering amount of the detection pattern formed immediately before.

9. The image forming method set forth in claim 8, wherein the number of sampling points is set to be larger as the toner adhering amount of the detection pattern formed immediately before is smaller.

10. The image forming method set forth in claim 6, wherein a plurality of the detection patterns are formed on the conveying rotation unit, and toner adhering amounts of the detection patterns are different from each other.

11. An image forming method for forming a detection pattern of a toner image on a conveying rotation unit by using a developing device set to a predetermined developing bias, detecting a toner adhering amount of the formed detection pattern, and setting imaging conditions for actual image formation, based on the detected toner adhering amount, comprising the steps for:

storing the toner adhering amount of the detected detection pattern; and setting a circumference-directional length of a detection pattern formed this time on a peripheral surface of a conveying rotation unit, based on the toner adhering amount formed and stored immediately before.

12. The image forming method set forth in claim 11, wherein the circumference-directional length of the detection pattern formed this time is set to be longer as the toner adhering amount of the detection pattern formed immediately before is smaller.

13. The image forming method set forth in claim 11, wherein detection of the toner adhering amount of the detection pattern is performed by obtaining an average value of a plurality of sampling points of the detection pattern, and a number of sampling points is set, based on the toner adhering amount of the detection pattern formed immediately before.

14. The image forming method set forth in claim 13, wherein the number of sampling points is set to be larger as the toner adhering amount of the detection pattern formed immediately before is smaller.

15. The image forming method set forth in claim 11, wherein a plurality of the detection patterns are formed on the conveying rotation unit, and toner adhering amounts of the detection patterns are different from each other.

* * * * *